US007004139B2

(12) United States Patent
Saito

(10) Patent No.: US 7,004,139 B2
(45) Date of Patent: Feb. 28, 2006

(54) ENGINE STARTER

(75) Inventor: Morihiro Saito, Tokyo (JP)

(73) Assignee: Kyodo Rubber Industries Co., Ltd., Tokyo (JP)

( * ) Notice: Subject to any disclaimer, the term of this patent is extended or adjusted under 35 U.S.C. 154(b) by 0 days.

(21) Appl. No.: 11/075,069

(22) Filed: Mar. 8, 2005

(65) Prior Publication Data

US 2005/0199212 A1 Sep. 15, 2005

(30) Foreign Application Priority Data

Mar. 9, 2004 (JP) ..... 2004-065608

(51) Int. Cl.
*F02N 1/00* (2006.01)

(52) U.S. Cl. ..... 123/185.3; 123/185.14

(58) Field of Classification Search ..... 123/185.2, 123/185.14, 185.3, 185.4
See application file for complete search history.

(56) References Cited

U.S. PATENT DOCUMENTS 4,582,030 A * 4/1986 Reese ..... 123/185.3
4,850,233 A * 7/1989 Ishigo ..... 74/6
5,287,832 A * 2/1994 Uhl ..... 123/185.3
5,862,787 A * 1/1999 Unuma et al. ..... 123/185.3
6,508,220 B1 * 1/2003 Akaike et al. ..... 123/185.14
6,739,303 B1 * 5/2004 Harada et al. ..... 123/185.14
6,782,863 B1 * 8/2004 Leasure et al. ..... 123/185.3

FOREIGN PATENT DOCUMENTS

JP 07174061 7/1995

* cited by examiner

*Primary Examiner*—Henry C. Yuen
*Assistant Examiner*—Arnold Castro
(74) *Attorney, Agent, or Firm*—Boyle Fredrickson Newholm Stein & Gratz S.C.

(57) ABSTRACT

An engine starter includes a rope reel to be rotated by a rope rounded thereon, a first spiral spring for recoiling and a second spiral spring for engine starting, both of the first and second springs being wound up by the rotation of the rope reel in order to accumulate a power therein, an engine starting pulley to be driven by the power accumulated in the second spiral spring, and a brake that suppresses rotation of the rope reel when the rotary speed of the rope reel at the recoiling is increased more than a predetermined value. The brake has a moving element that is moved by a centrifugal force generated by the rotation of the rope reel.

2 Claims, 5 Drawing Sheets

ENGINE STARTER

BACKGROUND OF THE INVENTION

1. Field of the Invention

The present invention relates to an engine starter and, more particularly, relates to an engine starter wherein a spring force accumulated in a spiral spring for driving a crank shaft of an engine can be dwindled into zero when a recoiling of a rope is completed.

2. Description of the Prior Art

In the conventional engine starter, such as a so-called recoil starter, an engine starting pulley is rotated by pulling manually a rope wound around the pulley, and the rotation of the pulley is transmitted to a crank shaft of an engine through a centrifugal clutch. In such recoil starter, however, a large pulling force must be applied rapidly to the rope, and accordingly it is difficult to operate positively by a person of feeble strength.

Further, in case that the engine is an internal combustion engine, air pressure in the engine cylinder is fluctuated, and accordingly it is difficult to pull the rope of the conventional recoil starter smoothly and easily according to the load.

In the other conventional engine starter as disclosed in the Japanese Patent Application Laid-Open No. 174061/95, a spiral spring for driving the engine and a one-way clutch are used, and a rope is pulled manually several times to accumulate the spring force in the spiral spring so as to drive the engine.

The other conventional engine starter using a self starting motor is complicated in structure and high in cost. Further, an electric power device for the motor is necessary, and if the electric charging of the electric power device is not sufficient, the motor cannot be actuated. Accordingly, in the outboard motor any conventional recoil starter must be equipped additionally for emergency use.

In case of the engine starter having a centrifugal clutch inserted between the engine starting pulley and the crank shaft of the engine, wherein a spring force is accumulated in the spiral spring by rotating the rope reel several times by pulling the rope in order to rotate the crank shaft, a large spring power is accumulated in the spiral spring before the engine is started, so that if the rope is released inadvertently before the crank shaft of the engine is started, the rope is recoiled rapidly by the power accumulated in the spiral spring, so that the engine starter housing is struck and damaged and the operator is injured by the knob of the rope.

SUMMARY OF THE INVENTION

In order to solve the foregoing problem in the conventional engine starter, it is an object of the present invention to provide an engine starter comprising a rope reel to be rotated by a rope rounded thereon, a first spiral spring for recoiling and a second spiral spring for engine starting, both of the first and second springs being wound up by the rotation of the rope reel in order to accumulate a power therein, an engine starting pulley to be driven by the power accumulated in the second spiral spring, and a brake means for suppressing the rotation of the rope reel when the rotary speed of the rope reel at the recoiling is increased more than a predetermined value.

Another object of the present invention is to provide an engine starter, wherein the brake means has a moving element to be moved by a centrifugal force generated by the rotation of the rope reel.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

DESCRIPTION OF THE PREFERRED EMBODIMENT

Figure 1:
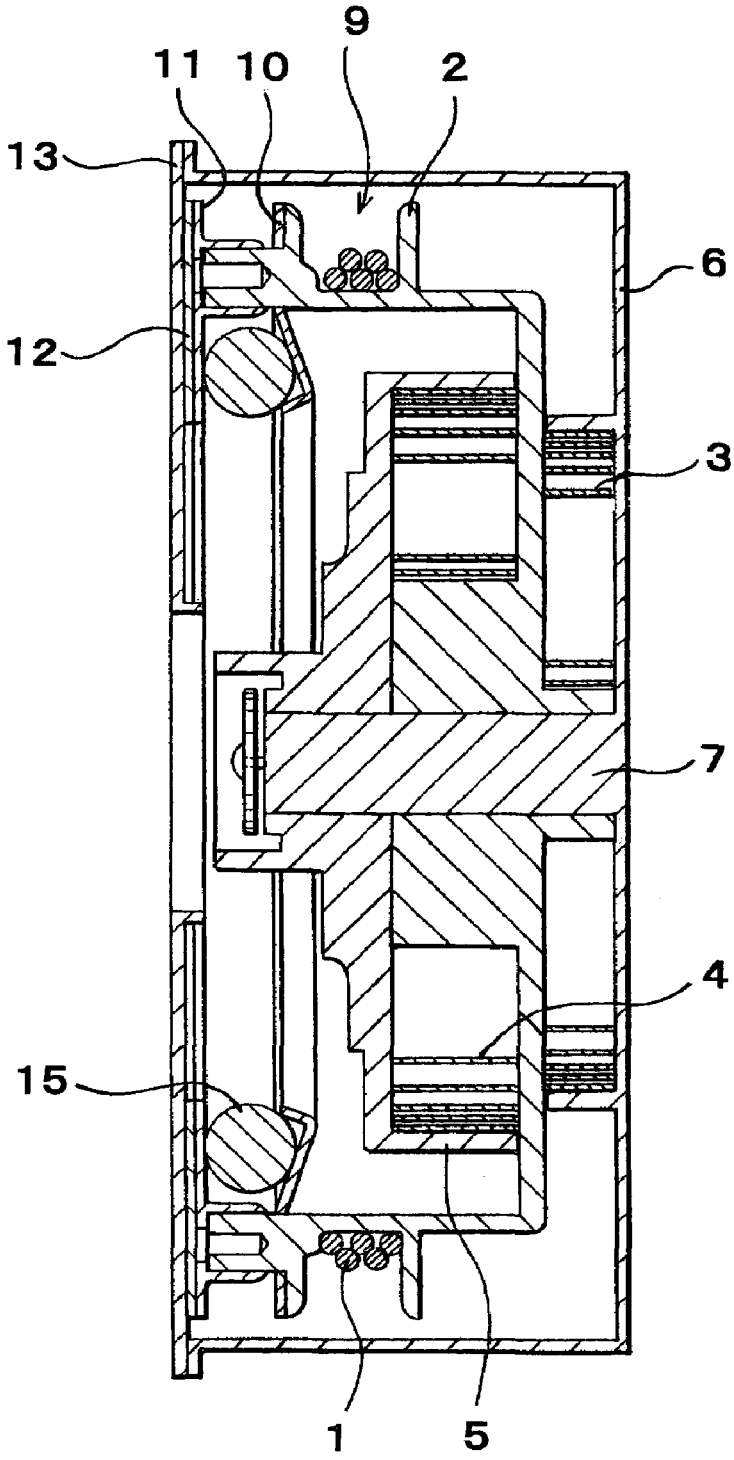
FIG. 1 is a vertically sectional view of an engine starter of the present invention.
Figure 2:
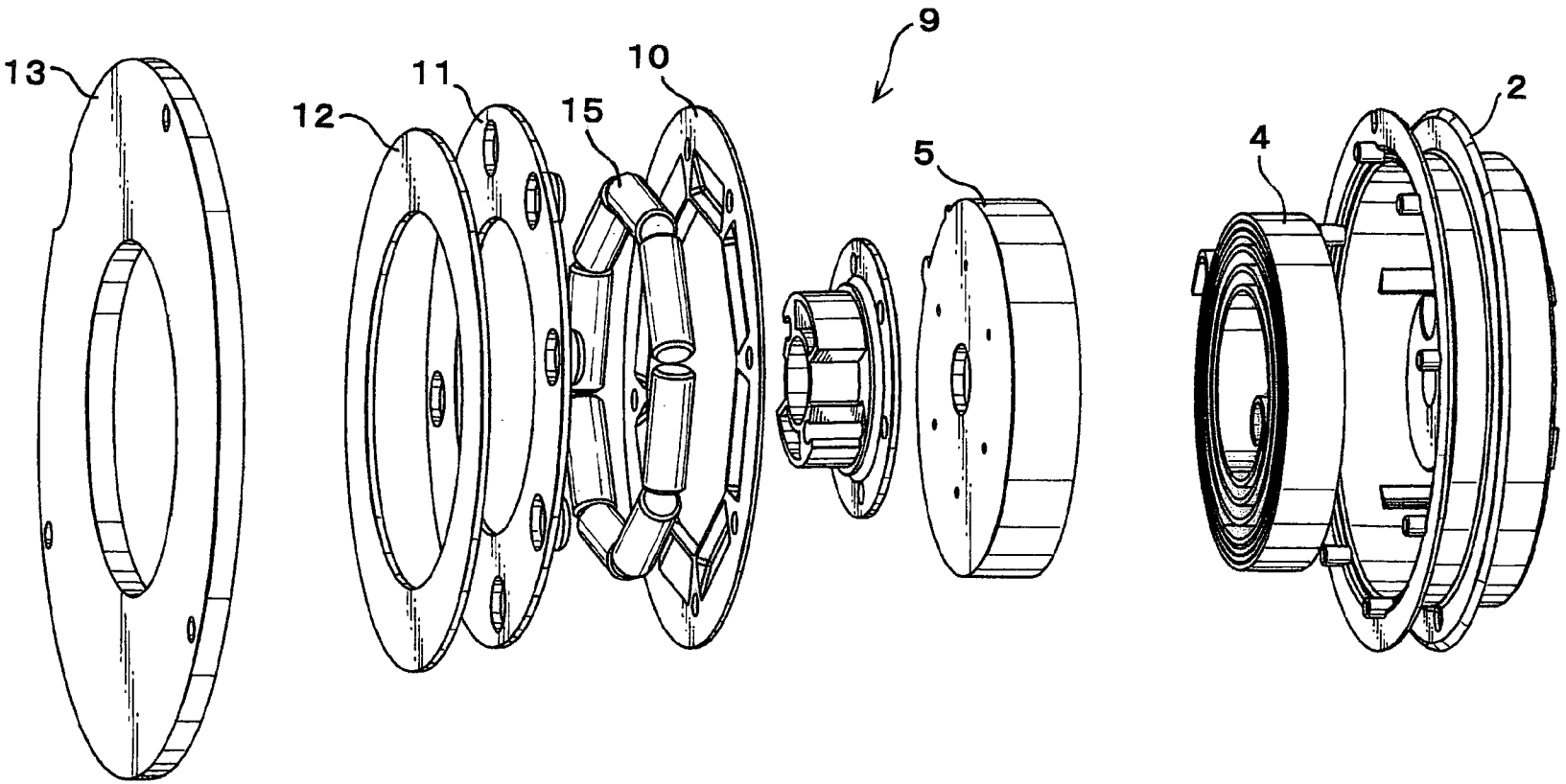
FIG. 2 is an exploded view of an engine starter shown in FIG. 1.
Figure 3:
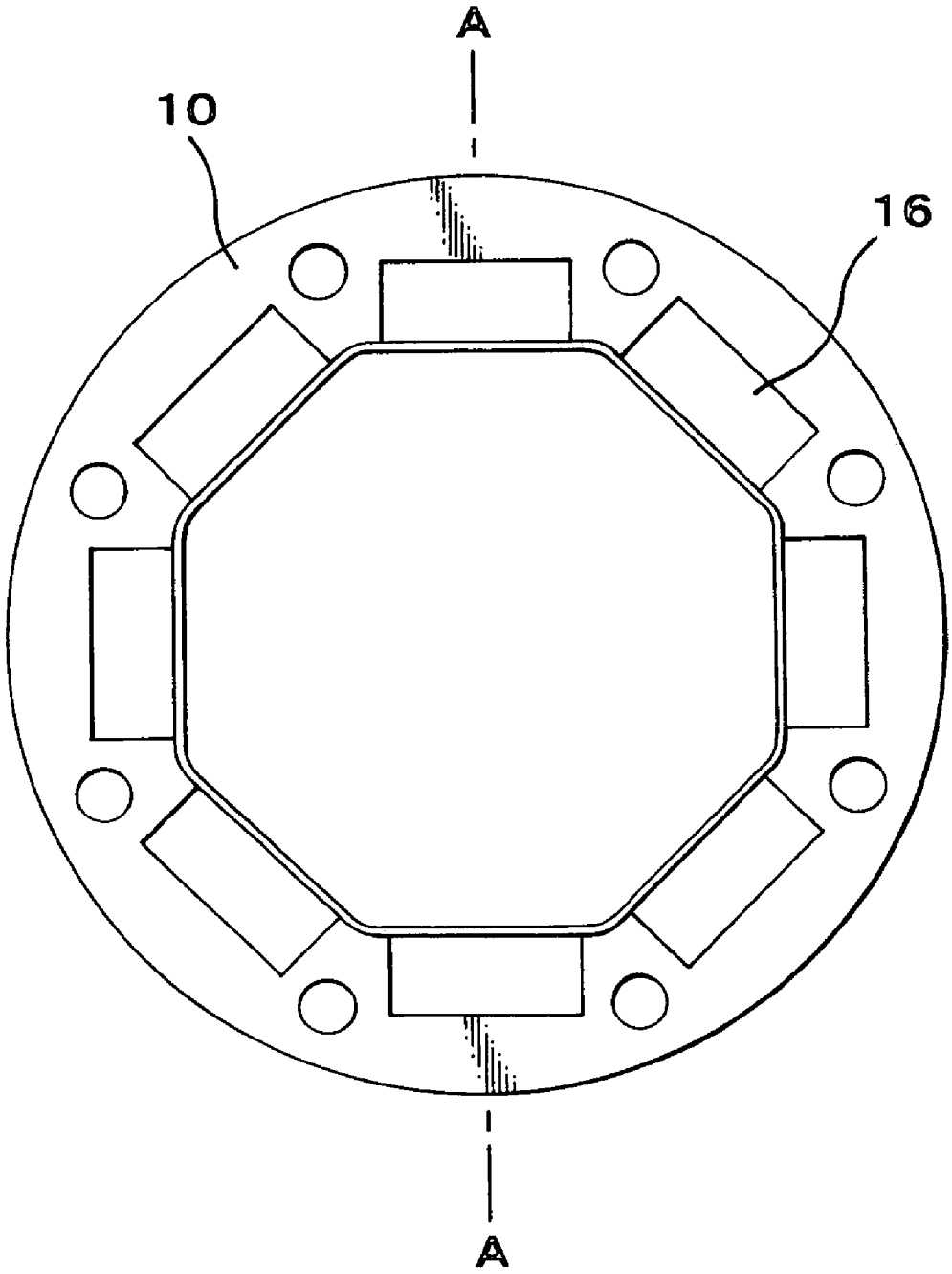
FIG. 3 is a plan view of a pressure plate of the engine starter shown in FIG. 1.
Figure 4:
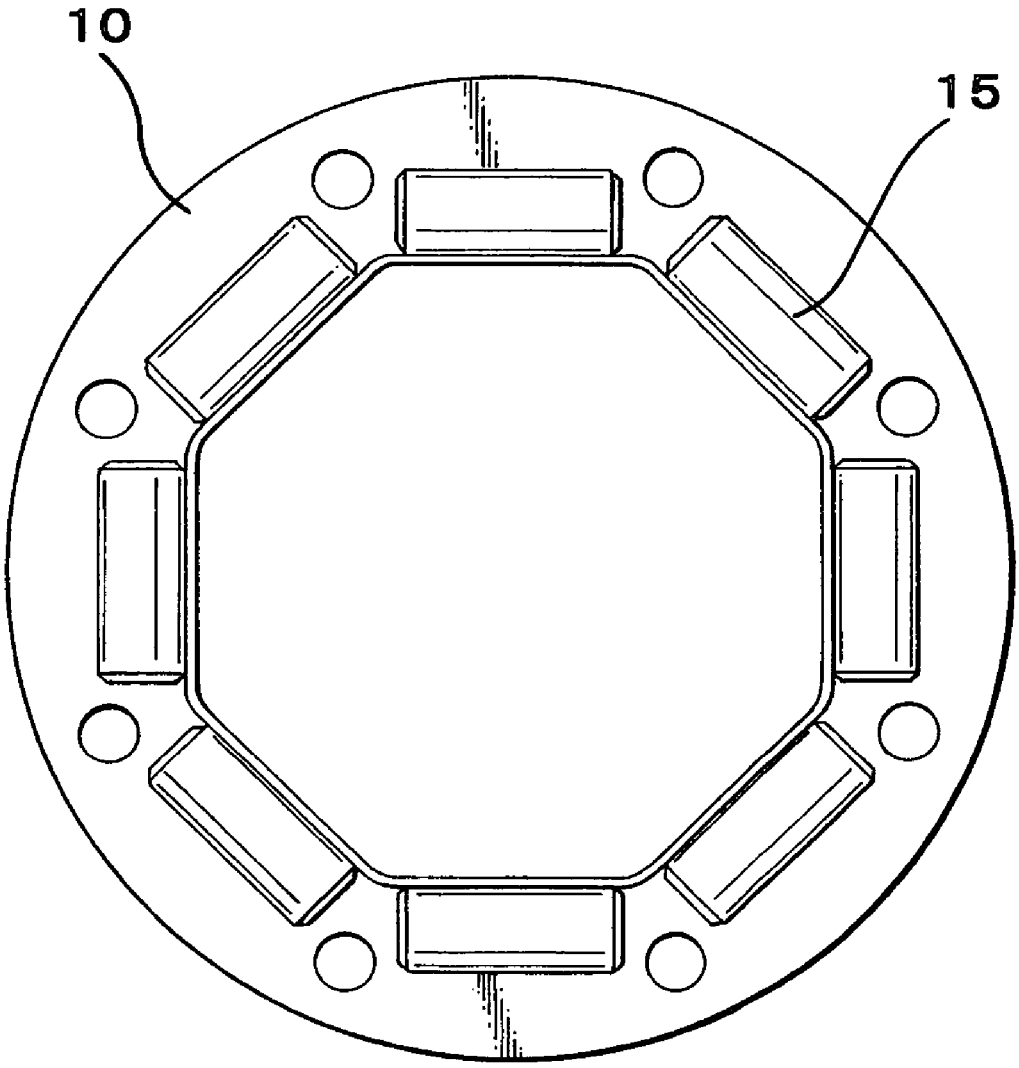
FIG. 4 is a plan view of the pressure plate shown in FIG. 3 overlapped with rollers.
Figure 5:
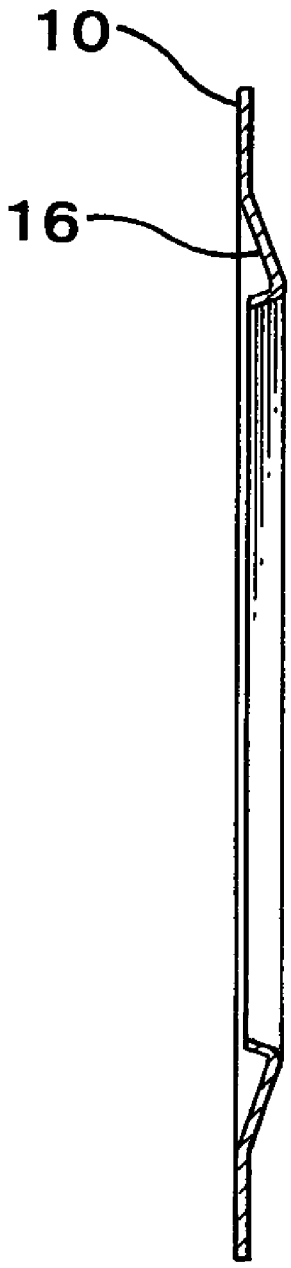
FIG. 5 is a vertically sectional view taken along a line A—A in FIG. 3.

The present invention will now be explained with reference to the drawings. FIG. 1 shows an engine starter according to the present invention. In FIG. 1, reference numeral 1 denotes a rope to be pulled manually, 2 denotes a rope reel to be rotated by the rope 1 wound around thereon, 3 denotes a first spiral spring arranged at one side of the reel 2, 4 denotes a second spiral spring arranged at the other side of the reel 2, 5 denotes an engine starting pulley to be driven by the second spiral spring 4, 6 denotes a stationary housing surrounding the rope reel 2, 7 denotes a shaft for supporting rotatably the rope reel 2 and the engine starting pulley 5 on the stationary housing 6, and 9 denotes a brake means for suppressing the rotation of the rope reel 2 when a rotary speed of the rope reel 2 is increased over a predetermined value at the recoiling state.

One end of the first spiral spring 3 is fixed to the rope reel 2, and the other end thereof is fixed to the stationary housing 6. One end of the second spiral spring 4 is fixed to the engine starting pulley 5, and the other end of the second spiral spring 4 is fixed to the rope reel 2.

FIG. 2 to FIG. 5, show details of the brake means 9 according to the present invention. In FIG. 2 to FIG. 5, a reference numeral 10 denotes a pressure plate connected to the rope reel 2 and rotated therewith, 11 to 13 denote a brake rotor, a friction pad fixed to the brake rotor, and a brake plate fixed to the stationary housing 6, respectively, arranged in this order coaxially, 15 denotes a plurality of rollers, each arranged between the pressure plate 10 and the brake rotor 11, and 16 denotes an inclined surfaces formed on one side surface of the pressure plate 10 facing the rollers 15, separated from one another in the circumferential direction thereof. Each of the inclined surfaces 16 is inclined by about 20 degrees toward the other side surface of the pressure plate 10 in order to form a concave portion for receiving the roller 15 therein. The brake rotor 11 is urged in the axial direction by a spring (not shown) so as to be separated from the friction pad 12 and so as to push the rollers 15 toward the pressure plate 10. The rollers 15 are moved radially outwardly on the inclined surfaces 16 of the pressure plate 10 by the centrifugal force, when the rotary speed of the pressure plate 10 connected to the rope reel 2 is increased over a predetermined value at the recoiling state, so that a distance between the pressure plate 10 and the brake rotor 11 is increased, that the brake rotor 11 is urged to the brake plate 13 through the friction pad 12, and that the rotation of the rope reel 2 is suppressed.

A ball and an inclined groove for receiving the ball may be used instead of the roller 15 and the inclined surface 16 for receiving the roller 15.

The brake means 9 is of the so-called disk type. However, a brake means of the so-called drum type may be used. In the drum type brake means, a brake drum (not shown) having a friction pad is arranged so as to face to the outer peripheral surface of the rope reel 2 or the pressure plate 10, and brake elements (not shown) which are moved radially outwardly by the centrifugal force generated by the rotation of the rope reel 2 or the pressure plate 10 are inserted between the brake drum and the rope reel 2 or the pressure plate 10.

The rotary speed of the rope reel 2 can be detected easily by detecting the peripheral speed of the rope reel 2 or the tension of the rope 1, for example.

According to the engine starter of the present invention, constructed as above, the engine is started as follows.

When the rope 1 is pulled manually, the reel 2 is rotated, so that the first and second spiral springs 3 and 4 are wound up.

The spring force accumulating in the second spiral spring 4 by one manual pulling action of the rope 1 is designed to a value sufficient to drive the crank shaft of the engine, so that the spring force accumulated in the second spiral spring 4 is used to drive the engine and then disappeared.

If the manual pulling action of the rope 1 is stopped in the course thereof, the spring force accumulated in the second spiral spring 4 is not disappeared, but is used for recoiling the rope 1 together with the spring force accumulated in the first spiral spring 3 through the reel 2, so that the spring force accumulated in the second spiral spring 4 is dwindled into zero, when the rope 1 is recoiled.

Further, the rope 1 is recoiled rapidly if the rope 1 is released inadvertently before the crank shaft of the engine is rotated by the torque or power accumulated in the second spiral spring 4. However, the brake means 9 is operated automatically when the rotary speed of the rope reel 2 is increased over the predetermined value. By the operation of the brake means 9, the rotation of the rope reel 2 is suppressed so as to prevent the housing 6 from being struck and damaged by a knob connected to the rope 1 and to prevent the operator from being injured.

While this invention has been described with specific embodiments thereof, it is evident that many alternatives, modifications, and variations will be apparent to those skilled in the art. Accordingly, the preferred embodiments of the invention as set forth herein are intended to be illustrative, not limiting. Various changes may be made without departing from the spirit and scope of the invention. The scope of the present invention should be defined by the terms of the claims appended hereto.

I claim:

1. An engine starter comprising a rope reel to be rotated by a rope rounded thereon, a first spiral spring for recoiling and a second spiral spring for engine starting, both of the first and second springs being wound up by the rotation of the rope reel in order to accumulate a power therein, an engine starting pulley to be driven by the power accumulated in the second spiral spring, and a brake means for suppressing the rotation of the rope reel when the rotary speed of the rope reel at the recoiling is increased more than a predetermined value, the brake means having a moving element that is moved by a centrifugal force generated by the rotation of the rope reel.

2. An engine starter comprising:

a rope reel that is driven to rotate in an engine starting direction using a rope rounded thereon and that also rotates in a recoiling direction;

a first spiral spring for recoiling and a second spiral spring for engine starting, both of the first and second springs being wound up by the rotation of the rope reel in the engine starting direction in order to accumulate potential energy therein;

an engine starting pulley that is driven by the potential energy accumulated in the second spiral spring; and a brake that suppresses the rotation of the rope reel when the rope wheel is rotating in the recoiling direction at a speed that is more than a predetermined value, wherein the brake has a moving element that is driven to move by a centrifugal force generated by the rotation of the rope reel.

* * * * *